United States Patent [19]

Abdullah et al.

[11] 4,431,247

[45] Feb. 14, 1984

[54] INSULATED TERMINAL AND MODULE

[75] Inventors: Sherif Abdullah, Plesantson, Calif.; Gary A. Baribeau, St. Paul, Minn.

[73] Assignee: Minnesota Mining and Manufacturing Company, Saint Paul, Minn.

[21] Appl. No.: 371,215

[22] Filed: Apr. 23, 1982

[51] Int. Cl.[3] ..... H01R 9/08

[52] U.S. Cl. ..... 339/97 P

[58] Field of Search ..... 339/97 R, 97 P, 98, 339/99 R

[56] References Cited

U.S. PATENT DOCUMENTS 4,283,104 8/1981 Pemberton ..... 339/97 R 4,283,105 8/1981 Ferrill et al. ..... 339/97 R

FOREIGN PATENT DOCUMENTS 1640633 10/1969 Fed. Rep. of Germany .... 339/97 R

*Primary Examiner*—Joseph H. McGlynn

*Attorney, Agent, or Firm*—Donald M. Sell; James A. Smith; Terryl K. Qualey

[57] ABSTRACT

An electrical terminal having a supporting body, a transversely perforate cap, and an enclosed tubular contact member having a bifurcate contact element in line with a wire cutting edge. Contact is established and excess wire removed by a twisting motion applied to the cap. Modular cross connect structure employing such terminals is described.

8 Claims, 11 Drawing Figures

INSULATED TERMINAL AND MODULE

This invention relates to electrical connectors, and in one particular aspect to connectors or terminals useful in modular form in providing insulation protected connections at cross connect or serving area exchange points in communications systems. Apparatus for the latter purpose typically includes terminals for 25 pairs of wires, arranged compactly in an array of rows and columns on a terminal block, for example as described in U.S. Pat. No. 4,210,378.

Prior art terminals which involve screw type binding posts or wire wrap posts require stripping of insulation from the wire ends, and the connection remains exposed. Another type of terminal requires the application to the bared wire end of a pin which is then inserted in a hollow socket. Stil another type, described in U.S. Pat. No. 283,105, involves an exposed longitudinally slit metal sleeve, into which the insulated wire is forced by means of a separate specially designed insertion tool.

The terminals of the present invention also employ a longitudinally slit tubular or sleevelike contact element. However the insulated wire is brought into electrically conductive contact with the element by a twisting rather than a thrusting motion; no special tools are required; and the completed connection, while being fully accessible for testing, is protected against casual or accidental contact.

Figure 1:
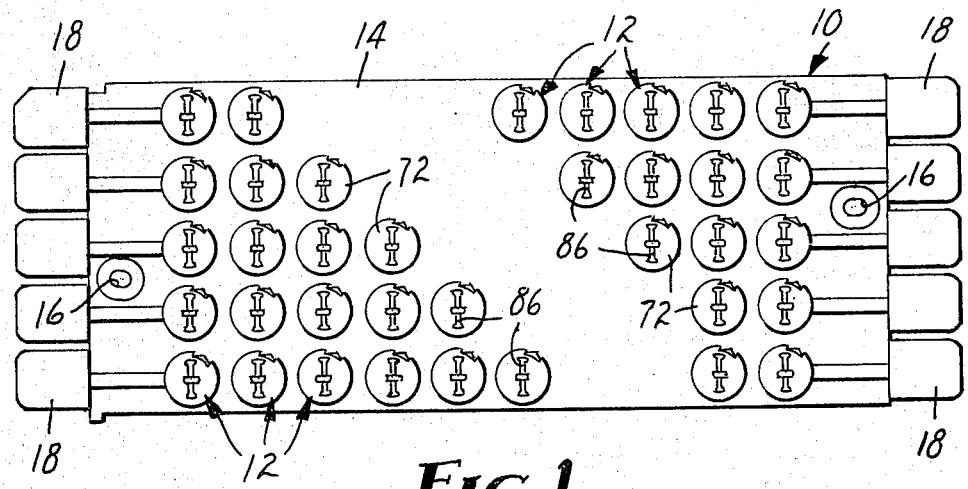
FIG. 1 is a plan view of a cross connect module comprising the terminals of the invention.
Figure 3:
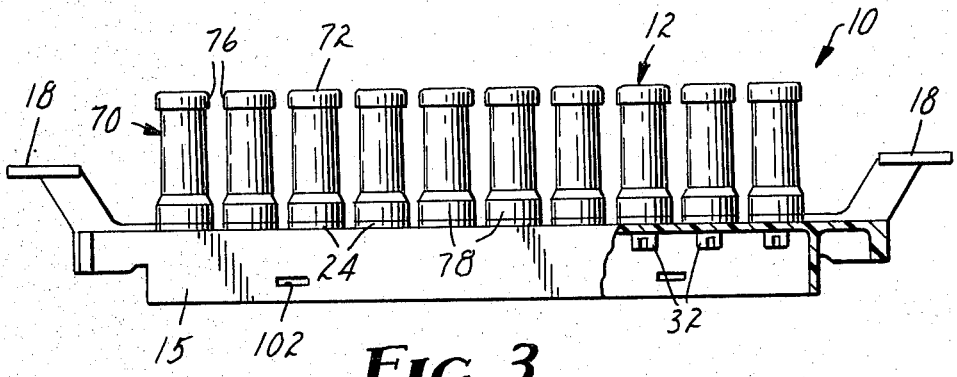
FIG. 3 is a side elevation, with a portion cut away, of the module of FIG. 1.
Figure 2:
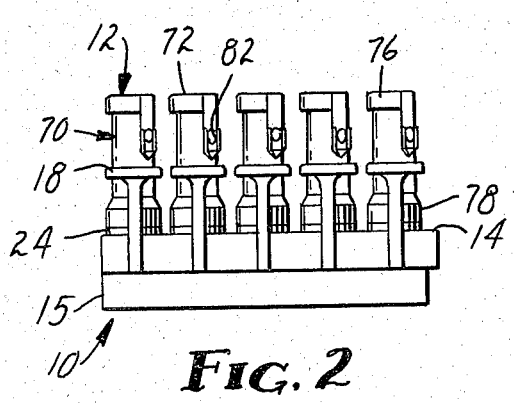
FIG. 2 is an end elevation.
Figure 4:
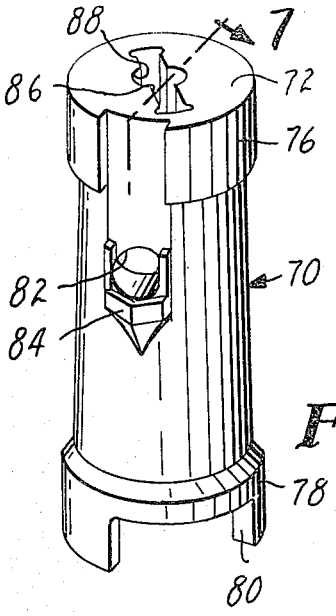
FIGS. 4, 5 and 6 are perspective views, in axial alignment, of cap, contact element, and body respectively of one of the terminals of the module of FIG. 1.

The module 10 of FIGS. 1–3 will be seen to include 50 spearate terminals 12, disposed in five rows and ten columns. The base 14, having lower walls 15, is dimensioned for mounting against a support within a cabinet by means of screws inserted through holes 16. Pads 18 at the ends of the base are provided for supporting and arranging individual wires or bundles of wires which are to be connected. Color coding is customarily added for ease of identification of tip and ring positions.

The body 20 is formed as a part of the base 14. It consists of a cup shaped segment having a slightly conical outer upper surface 22 and an enlarged ring 24 at the base 14. A stop 26 extends upwardly from one side of the ring 24, and a detent 28 protrudes inwardly from the opposite lower inner surface. The bottom of the cup, forming a portion of the base 14, is perforate at arcuate perforation 30 and carries raised blocks 32 and 34 on the outer surface. Blocks 32 include opposing extensions 36 which define a wire retaining pathway in alignment with the center of the arcuate perforation 30.

Figure 5:
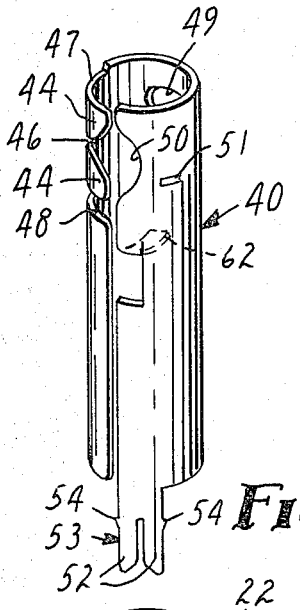
Figure 6:
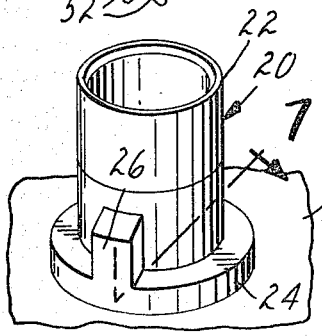
Figure 9:
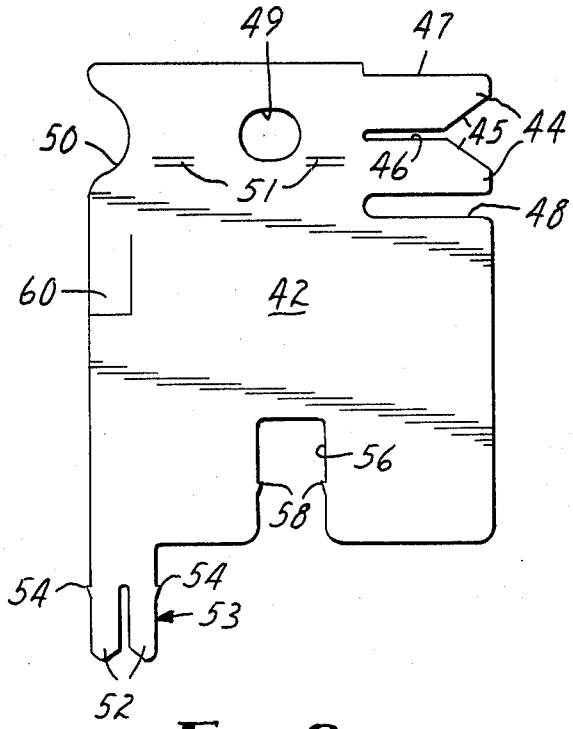
FIG. 9 is a plan view of the blank for the contact element of FIG. 5.

The tubular member 40 of FIG. 5 is formed from the flat blank 42 of FIG. 9. It has a pair of laterally directed contact fingers 44 defining an open mouthed wire receiving slow 46. A marginal space or partial slot 47 above, and a second slot 48 below, serve to isolate the resulting bifurcate contact element and to permit necessary slight deflection of the contact fingers during insertion of a wire in slot 46. Perforation 49, and semicircular concavity 50 together with the open mouth of the contact element between the angled inner edges 45 at the tips of fingers 44, form a transverse passageway for a wire end through the tubular connecting member 40.

Sharp edged retention ridges 51 are located along a circumference on the upper portion of the member 40.

A second pair of contact fingers 52 depending from the lower edge of the member 40 and forming an extended second bifurcate contact element 53 extends through the arcuate opening 30 in the base and against and beyond the block 34. Angular projections 54 on the longitudinal edges of the extension penetrate the walls of the opening and anchor the member to the base.

The member 40 is further slotted from the lower edge to form a wide slot 56. The side edges defining the slot carry angular anchor projections 58. The inner detent 28 of the body 20 fits snugly within the slot 56 and prevents rotation of the connecting member within the body. The projections 58 penetrate the edges of the detent and assist in anchoring the member against removel.

Figure 7:
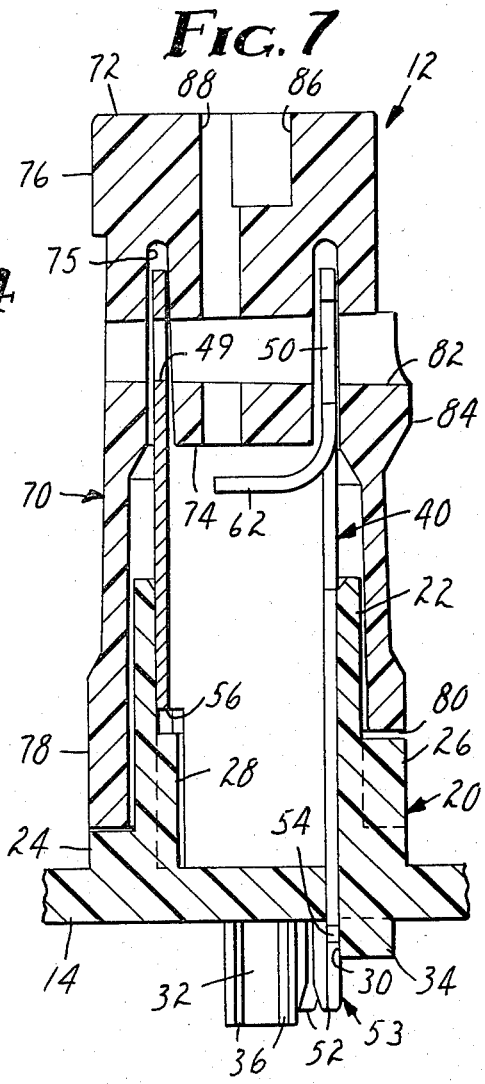
FIG. 7 is a longitudinal cross section of the assembled terminal of FIGS. 4–6 taken approximately at section 7—7 of FIGS. 4–6.

A tongue 60 forming a part of the edge of the blank 42 beneath the concavity 50 is bent inwardly to form contact tab 62 extending horizontally across the center of the cylindrical connecting member 40, as shown in FIG. 7.

The cap 70 is also cylindrical, with a closed upper end 72 from which depends a central column 74, leaving an annular space 75. The cap fits over the upper portion of the tubular member 40 which extends into the annular space 75, and over the tubular shell of the body 20. Upper and lower portions 76, 78 of the cap are radially enlarged for increased strength. A segment of the lower rim is omitted, leaving a space 80 which permits the cap to fit over the stop 26 on the body 20 and to be rotated thereon through approximately one quarter turn.

The cap, including the central column 74, is laterally perforate at the level of the transverse passageway in the member 40, to provide a wire receiving channel 82. The outer surface of the cap is enlarged and chamfered below the entrance to this channel, as at boss 84, so as to facilitate the insertion of a wire end into the channel.

The top of the cap is slotted and perforate. As illustrated in FIG. 1, the slot 86 is in line with the column when the connector is open to receive a wire end, with the right edge of the lower cap portion 78 against the stop 26. The perforation 88 is parallel to and closely adjacent the longitudinal axis; it extends through the central column 74 and in line with the contact tab 62.

The tubular connecting member 40 remains under slight radial compression within the body 20 and cap 70, so that its surface remains tightly pressed against the contacting insulative surfaces. An effective scissors action is thereby obtained between the edges of perforations 82 and 49 when the cap is rotated.

The cap is retained in place over the connecting member by the retaining ridges 51 which penetrate the plastic insulating material.

Cross connect wires are connected to the individual terminals by inserting the wire end through the aperture 82 and twisting the cap through the arc permitted by the stop 26. The wire is forced between the fingers 44 which displace the insulation and make spring compression reserve contact with the conductor. The free end is sheared off at the opposite side of the terminal and is removed. The entire contact area is protected from accidental contact with other wire ends, tools or the like by the enclosing cap. Twisting action is accomplished with an ordinary screwdriver, the bit fitting into the slot 86. If contact with the connection is desired, as for testing purposes, the aperture 88 provides for access of a suitable test probe to the tab 62.

The combination of cap and contact member is generally useful in the connector and terminal art, but offers particular advantages when incorporated in multiple terminal arrays as shown in FIG. 1 and which are offered in partly prewired or predetermined condition as will now be described.

Figure 8:
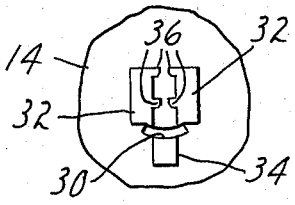
FIG. 8 is a bottom plan view of the body of FIG. 6.

With the structure shown in FIGS. 1, 7 and 8, wire segments are forced into the contacts 53 and between the opposing extensions 36, using a suitable insertion tool. Any excess of wire is simultaneously cut off by knife action of the tool against the block 34. Somewhat analogous tool design and action is shown in U.S. Pat. No. 4,210,378. The free ends of the wire segments are bundled together, and the connections are sealed in place by embedding with a suitable sealant applied over the bottom surface of the base 14 and at least partially filling the space defined by the walls 15.

Pretermination may also be accomplished during assembly of the terminals. A wire segment is forced into position against the lower surface of the base 14, within the channel between the blocks 32 and extensions 36, and across the arcuate perforation 30, and held in place with a supporting jig while the connecting member 40 is inserted through the body 20. The several wires are then bundled and the connections embedded as already described.

Figure 10:
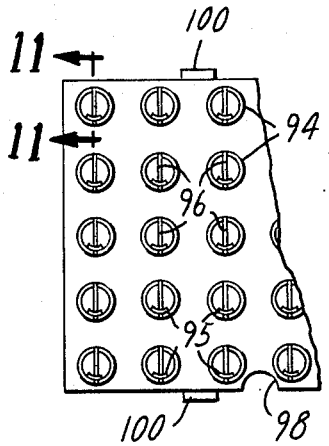
FIG. 10 is a top plan view of a portion of a closure assembly.
Figure 11:
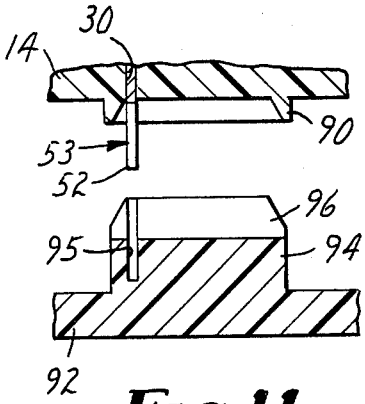
FIG. 11 is a sectional elevation of a single terminal closure together with the corresponding modified body structure, taken at section 11—11 of FIG. 10.

An alternative structure and method is indicated in FIGS. 10 and 11. Here the contact member 53 protrudes from the base 14 through the arcuate perforation 30 surrounded by a low ring 90. A closure plate 92 carries circular projections 94 in alignment with the rings 90. Each projection is deeply arcuately recessed at recess 95 to receive the contact 53 and has a wire receiving slot 96 in line with the center of the perforation 30. Wire segments are first inserted in the slots 96, and any excess removed by knife action against the surface of the plate 92. The free ends of the wires are bundled together and brought through an edge opening 98. The assembly is then forced into position against the lower surface of the base 14. The slanted edges of the projections 94 fit tightly against the edges of the rings 90, and contacts 53 make connection with the wires in the projections. Projections 100 snap into openings 102 in the side walls 15 of the base 14 and hold the plate in place.

What is claimed is as follows:

1. An electrical terminal comprising:

a cylindrical contact member having an open longitudinal seam, transversely slotted from one side of said seam to form and isolate an open mouthed bifurcate contact element, having a concavity at the other side of said seam opposite said element and forming with said open mouth a wire entry passage, and a perforate opposite said wire entry passage to form a wire exit passage having a wire cutting edge; and a cap member rotatably associated with said cylindrical member and channeled in line with said passages for receiving a wire and forcing said wire into said contact element and against said wire cutting edge.

2. Terminal of claim 1 wherein said cap is enlarged and chamfered at the wire entry end of said transverse perforations for facilitating insertion of a wire end.

3. Terminal of claim 1 wherein said contact member includes a contact tab extending across the central axis beneath said wire passages and said cap is axially perforate in alignment with said tab.

4. Terminal of claim 1 wherein said contact member is rigidly supported within a body member and includes a second contact member extending from said body member.

5. Terminal of claim 4 wherein is included means for restricting rotation of said cap to the degree necessary to establish electrical connection with an inserted wire while severing excess wire.

6. Terminal of claim 4 wherein said second contact member is bifurcate.

7. Terminal of claim 6 wherein said terminal is a unit of a modular structure containing a plurality of said terminals disposed in rows and columns with the body members being combined in a unitary base structure.

8. Terminal of claim 7 wherein each said terminal is preconnected to a separate segment of insulated wire at its said second contact member and all said connections are sealed.

* * * * *